United States Patent [19]

Söderberg et al.

[11] Patent Number: 4,743,356

[45] Date of Patent: May 10, 1988

[54] INCREASING RESID HYDROTREATING CONVERSION

[75] Inventors: David J. Söderberg, Naperville, Ill.; Norman K. McDaniel, Dickinson; Norman R. Woods, League City, both of Tex.

[73] Assignee: Amoco Corporation, Chicago, Ill.

[21] Appl. No.: 911,102

[22] Filed: Sep. 24, 1986

[51] Int. Cl.[4] ..... C10G 47/00

[52] U.S. Cl. ..... 208/101; 208/143; 208/57

[58] Field of Search ..... 208/57, 58, 76, 101, 208/108, 143, 146; 423/220, 242

[56] References Cited

U.S. PATENT DOCUMENTS

| | | | |
|---|---|---|---|
| 2,662,846 | 12/1963 | Montgomery et al. | 208/146 |
| 2,987,465 | 6/1961 | Johanson | 208/146 X |
| 3,208,933 | 9/1965 | Smith | 208/57 |
| 3,898,049 | 8/1975 | Burroughs et al. | 208/57 X |
| 4,036,734 | 7/1977 | Manne et al. | 208/57 |
| 4,159,935 | 7/1979 | Scott | 208/101 |
| 4,212,726 | 7/1980 | Mayes | 208/101 |
| 4,576,710 | 3/1986 | Nongbri et al. | 208/58 |

OTHER PUBLICATIONS

"Chemical Reaction Engineering", Levenspiel, John Wiley & Sons, 1972, pp. 101-105.

*Primary Examiner*—Helen M. S. Sneed
*Assistant Examiner*—Glenn Caldarola
*Attorney, Agent, or Firm*—Thomas W. Tolpin; William H. Magidson; Ralph C. Medhurst

[57] ABSTRACT

Resid hydrotreating conversion of resid can be substantially increased by decreasing the feed gas rate and simultaneously increasing the concentration of hydrogen in the feed gases. Hydrogen purity can be increased by increasing the flow rate of lean sponge oil into the sponge oil absorbers, bleeding some of the recycled reactor tail gases, and increasing the makeup gas rate.

13 Claims, 5 Drawing Sheets

INCREASING RESID HYDROTREATING CONVERSION

BACKGROUND OF THE INVENTION

This invention relates to resid hydrotreating and, more particularly, to a process for increasing the conversion of 1,000+° F. resid in a resid hydrotreating unit.

In the past, spiraling oil costs, extensive price fluctuations, and artificial output limitations by the cartel of oil producing countries (OPEC) have created instability and uncertainty for net oil consuming countries, such as the United States, to attain adequate supplies of high-quality, low-sulfur, petroleum crude oil (sweet crude) from Saudi Arabia, Nigeria, Norway, and other countries at reasonable prices for conversion into gasoline, fuel oil, and petrochemical feedstocks. In an effort to stabilize the supply and availability of crude oil at reasonable prices, Amoco Oil Company has developed, constructed, and commercialized extensive, multimillion dollar refinery projects under the Second Crude Replacement Program (CRP II) to process poorer quality, high-sulfur, petroleum crude oil (sour crude) and demetalate, desulfurize, and hydrocrack resid to produce high-value products, such as gasoline, distillates, catalytic cracker feed, metallurgical coke, and petrochemical feedstocks. The Crude Replacement Program is of great benefit to the oil-consuming nations by providing for the availability of adequate supplies of gasoline and other petroleum products at reasonable prices while protecting the downstream operations of refining companies.

During resid hydrotreating, such as under Amoco Company's Crude Replacement Program, resid oil (resid) is upgraded with hydrogen and a hydrotreating catalyst in a three-phase equilibrium of oil, catalyst, and gas bubbles to produce more valuable lower-boiling liquid products. In order to increase the efficiency, effectiveness, and profitability of resid hydrotreating, it is desirable to maximize the conversion of resid to more valuable lower-boiling liquid products.

The extent of conversion of resid to more valuable lower-boiling liquid products depends in part on the residence time of the resid in the reactor. During resid hydrotreating, hydrogen gas bubbles occupy a substantial portion of the reactor and thereby decrease the available space and residence time of the resid oil. Gas holdup can be reduced by decreasing the feed gas rate which then increases the liquid residence time. Decreasing the feed gas rate in such a manner, however, usually causes decrease of hydrogen partial pressure and subsequent coking of catalyst in the downstream reactors and loss of catalyst activity. Increasing the temperature of the reactor can increase the extent of conversion but can also increase catalyst coking and may be limited by the materials of construction of the reactor. Decreasing the resid feed rate into the reactor normally decreases the number of barrels of more valuable lower-boiling liquid products. Increased catalyst coking (coke formation) can lead to shutdown, extended downtime, increased frequency of repair, decreased efficiency, and reduced product quality.

It is, therefore, desirable to provide an improved hydrotreating process for increasing the conversion of resid which overcomes most, if not all, of the above problems. lems.

SUMMARY OF THE INVENTION

An improved hydrotreating process is provided to increase the conversion of resid (resid oil) to more valuable lower-boiling liquid products, such as naphtha (gasoline) and distillates (diesel fuel, kerosene), without increasing catalyst coke formation, downtime, and frequency of repair.

The novel hydrotreating process is useful in fixed bed hydrotreaters, slurry bed hydrotreaters, entrained bed hydrotreaters, hydrovisbreakers, and especially in ebullated bed hydrotreaters.

Advantageously, the novel hydrotreating process is efficient, effective, and economical. It improves product yield and increases profitability. Desirably, the novel process decreases gas holdup in the reactors and increases usable conversion volume in the reactors.

In the hydrotreating process, resid and a hydrogen-containing gas are fed to a reactor and preferably to a train of reactors. In the reactors, the resid reacts thermally in the presence of hydrogen-containing gas and a hydrotreating catalyst under hydrotreating conditions to convert a substantial portion of the resid to more valuable liquid hydrocarbons.

In order to increase the conversion of resid, the feed rate of the hydrogen-containing gas into the reactors is decreased and the hydrogen concentration (purity) of the feed gas is simultaneously increased to maintain the hydrogen partial pressure in the reactors. Since the feed gas typically contains recycled reactor tail gases (effluent off gases) for process efficiency and economy, the hydrogen concentration of the feed gas can be increased by removing excess heteroatom gases and light hydrocarbons (methane, ethane) from the reactor tail gases before the tail gases are recycled back to the reactors as part of the feed gas. In the preferred form, light hydrocarbon gas removal is accomplished by increasing the flow rate of lean sponge oil in the high-pressure sponge oil absorber to increase the sponge oil absorption of methane and ethane.

The concentration of hydrogen in the feed gas can be further increased by increasing the proportion of hydrogen-rich makeup gases in the feed gas. This can be accomplished by adding hydrogen-rich makeup gases containing at least 95% by volume hydrogen to the feed gas while simultaneously bleeding or spilling some of the tail gases for use as fuel to attain the desired material balance. Makeup gases can be expensive and, therefore, the increased use of makeup gases and the simultaneous bleeding of tail gases are best implemented at feed gas hydrogen purity levels of 80% or higher.

A more detailed explanation of the process is provided in the following description and the appended claims taken in conjunction with the accompanying drawings.

DETAILED DESCRIPTION OF THE PREFERRED EMBODIMENT

Figure 2:
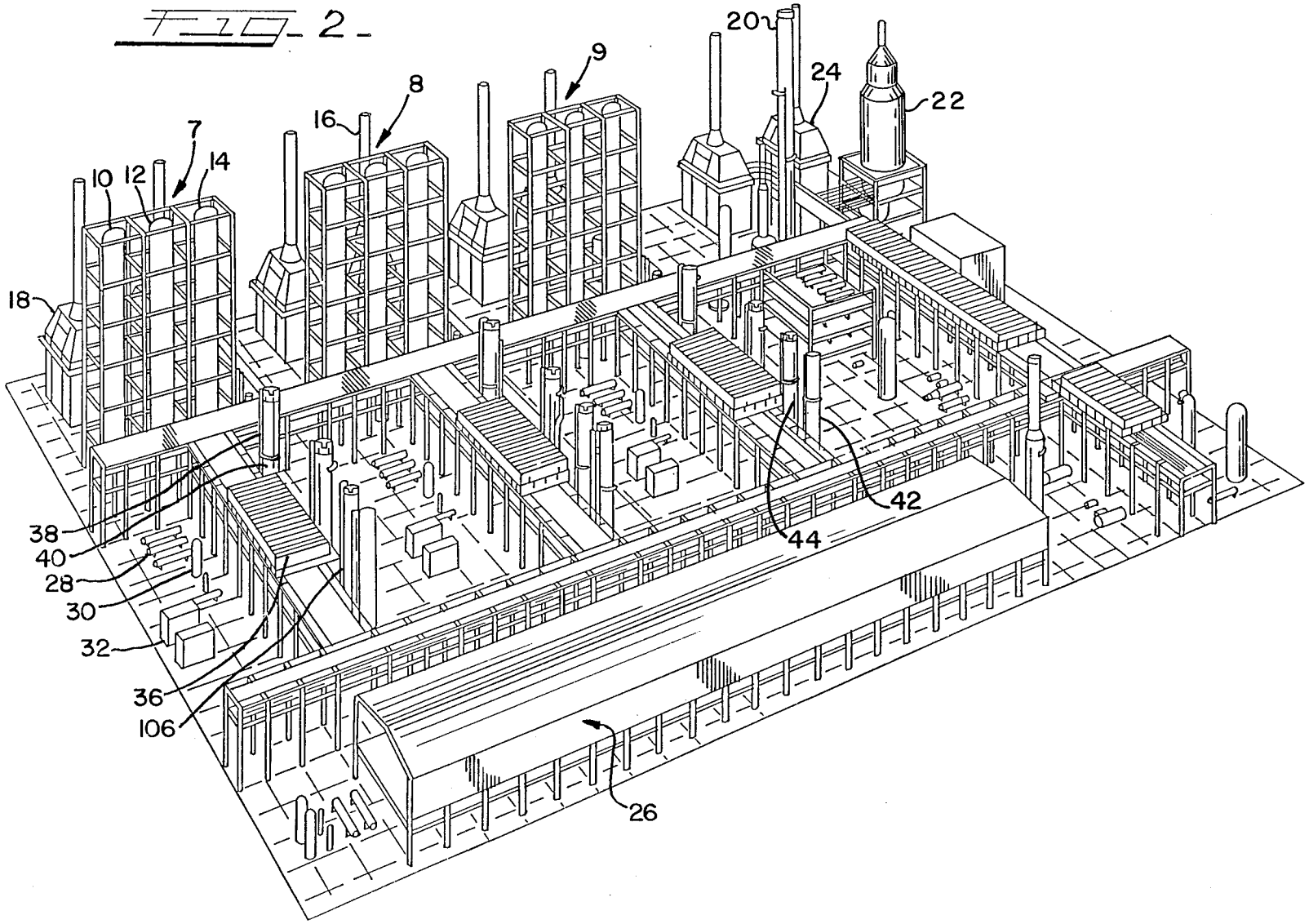
FIG. 2 is a prospective view of resid hydrotreating units and associated refinery equipment for carrying out the process.

High-sulfur resid oil feed, also referred to as sour crude or vacuum-reduced crude, comprising 1,000+° F. resid and heavy gas oil, is fed into resid hydrotreating units (RHU) 7, 8, 9 (FIG. 2) along with a hydrogen-rich feed gas. Each resid hydrotreating unit is a reactor train comprising a cascaded series or set of three ebullated (expanded) bed reactors 10, 12, and 14. In the reactors, the resid is hydroprocessed (hydrotreated) in the presence of fresh and/or equilibrium hydrotreating catalyst and hydrogen to produce an upgraded effluent product stream with reactor tail gases (effluent off gases) leaving used spent catalyst. Hydroprocessing in the RHU includes demetalation, desulfurization, denitrogenation, resid conversion, oxygen removal (deoxygenation), and removal of Rams carbon.

The resid hydrotreating units and associated refining equipment (FIG. 2) comprise three identical parallel trains of cascaded ebullated bed reactors 10, 12, and 14, as well as hydrogen heaters 16, influent oil heaters 18, an atmospheric tower 20, a vacuum tower 22, a vacuum tower oil heater 24, a hydrogen compression area 26, oil preheater exchangers 28, separators 30, recycled gas compressors 32, air coolers 36, raw oil surge drums 38, sponge oil flash drums 40, amine absorbers and recycle gas suction drums 42, and sponge oil absorbers and separators 44.

Each of the reactor trains comprises three ebullated bed reactors in series. The oil feed typically comprises resid oil (resid) and heavy gas oil. The feed gas comprises upgraded recycle gases and fresh makeup gases. Demetalation primarily occurs in the first ebullated bed reactor in each train. Desulfurization occurs throughout the ebullated bed reactors in each train. The effluent product stream typically comprises light hydrocarbon gases, hydrotreated naphtha, distillates, light and heavy gas oil, and unconverted hydrotreated resid. The hydrotreating catalyst typically comprises a hydrogenating component on a porous refractory, inorganic oxide support.

The resid hydrotreating unit is quite flexible and, if desired, the same catalyst can be fed to one or more of the reactors or a separate demetalation catalyst can be fed to the first reactor while a different catalyst can be fed to the second and/or third reactors. Alternatively, different catalysts can be fed to each of the reactors, if desired. The used spent catalyst typically contains nickel, sulfur, vanadium, and carbon (coke). Many tons of catalyst are transported into, out of, and replaced in the ebullated bed reactors daily.

Figure 3:
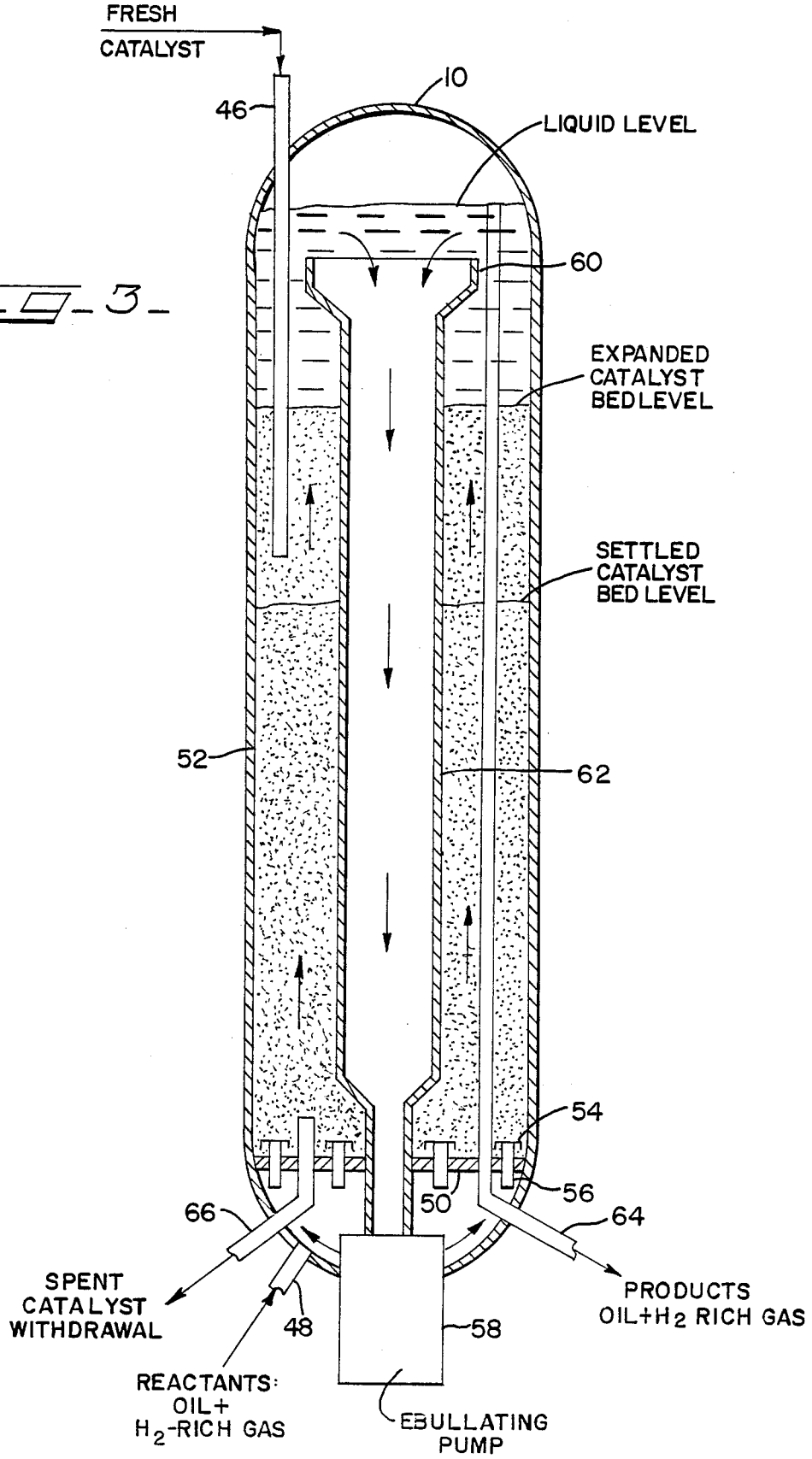
FIG. 3 is a cross-sectional view of an ebullated bed reactor.

As shown in FIG. 3, fresh hydrotreating catalyst is fed downwardly into the top of the first ebullated bed reactor 10 through the fresh catalyst feed line 46. Hot resid feed and hydrogen-containing feed gases enter the bottom of the first ebullated bed reactor 10 through feed line 48 and flow upwardly through a distributor plate 50 into the catalyst bed 52. The distributor plate contains numerous bubble caps 54 and risers 56 which help distribute the oil and the gas across the reactor and prevent catalyst from falling into the bottom section of the reactor. An ebullating pump 58 circulates oil from a recycle pan 60 through a downcomer 62 and the distributor plate 50. The rate is sufficient to lift and expand the catalyst bed from its initial settled level to its steady state expanded level. The effluent product stream of partially hydrotreated oil and hydrogen-rich reactor tail gases (off gases) is withdrawn from the reactor through effluent product line 64. The used spent catalyst is withdrawn from the bottom of the reactor through spent catalyst discharge line 66. The spent catalyst typically contains deposits of metals, such as nickel and vanadium, which have been removed from the influent feed oil (resid) during hydrotreating.

Catalyst particles are suspended in a three-phase mixture of catalyst, oil, and hydrogen-rich feed gas in the reaction zone of the reactor. Hydrogen-rich feed gas typically continually bubbles through the oil. The random ebullating motion of the catalyst particles results in a turbulent mixture of the phases which promotes good contact mixing and minimizes temperature gradients.

The cascading of the ebullated bed reactors in a series of three per reactor train, in which the effluent of one reactor serves as the feed to the next reactor, greatly improves the catalytic performance of the backmixed ebullated bed process. Increasing the catalyst replacement rate increased the average catalyst activity.

Figure 1:
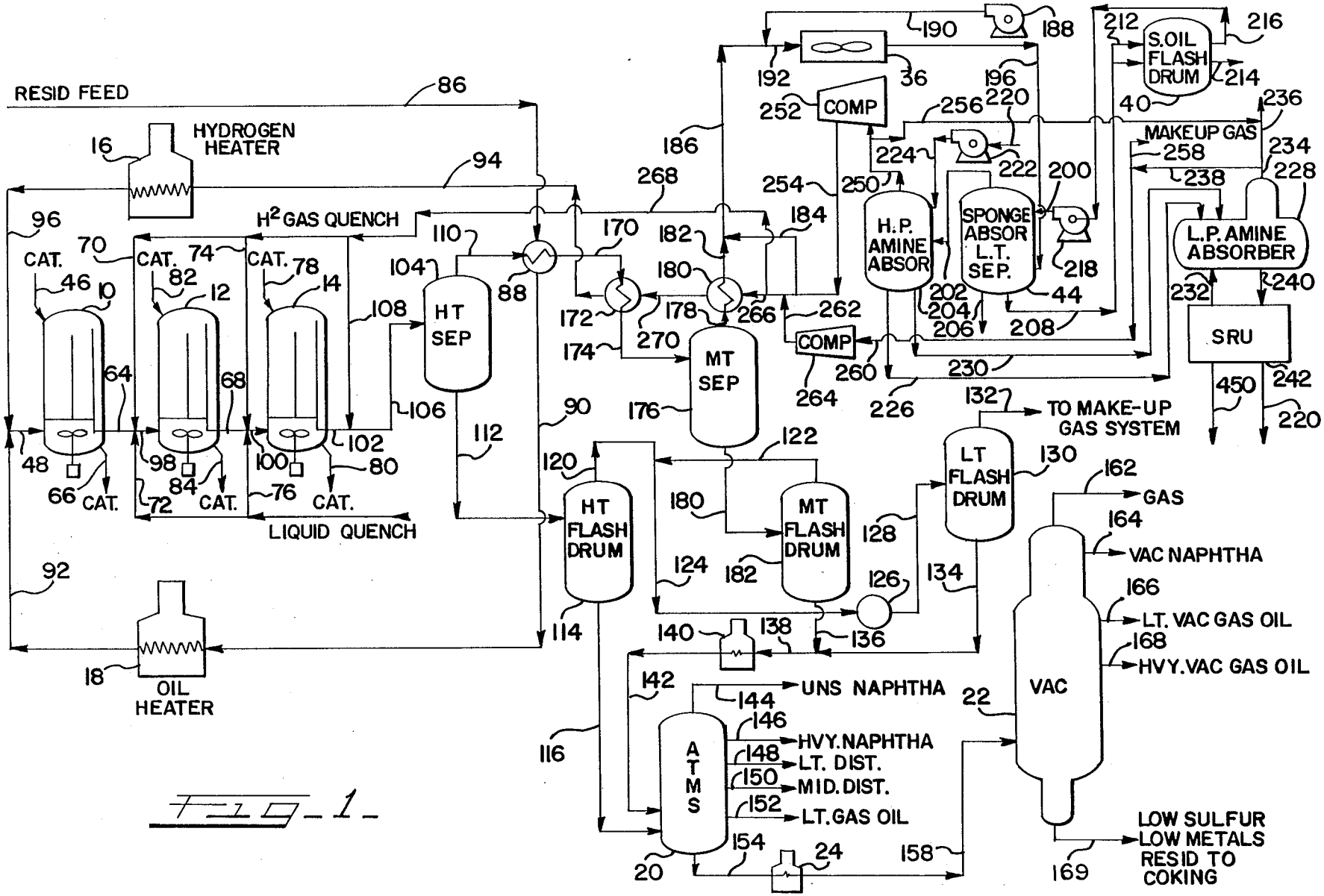
FIG. 1 is a schematic flow diagram of the hydrotreating process in accordance with principles of the present invention.

As shown in FIG. 1, the partially hydrotreated effluent in the outlet line 64 of the first ebullated bed reactor 10 comprises the influent feed of the second ebullated bed reactor 12. The partially hydrotreated effluent in the outline line 68 of the second ebullated bed reactor 12 is the influent feed of the third ebullated bed reactor 14. The second and third reactors are functionally, operatively, and structurally similar to the first reactor and cooperate with the first reactor to effectively hydrotreat and upgrade the influent feed oil. Quench liquid (oil) and/or hydrogen-containing gas can be injected into the influent feeds of the second and third reactors through quench lines 70, 72, 74 and 76 to cool and control the bulk temperatures in the second and third reactors. Fresh catalyst can be fed into the top of all the reactors, although for process efficiency and economy it is preferred to utilize catalyst staging by feeding fresh catalyst into the first and third reactors through fresh catalyst feed lines 46 and 78 and by feeding recycled spent catalyst from the third reactor into the second reactor through recycle catalyst lines 80 and 82. Used spent catalyst is discharged from the reactor through spent catalyst discharge lines 66 and 84.

Preferably, the resid feed, which may contain some heavy gas oil, is heated in the oil heater 18, and the hydrogen-containing feed gas is heated in the hydrogen heater 16 before being combined and fed through the feed line 48 into the first reactor for process efficiency.

The fluid state of the ebullated hydrotreating catalyst enhances the flexibility of the ebullated bed reactors and permits the addition or withdrawal of oil/catalyst slurry without taking the reactors offstream. Daily catalyst replacement results in a steady state equilibrium catalyst activity.

Products are withdrawn from the third reactor 14 and are separated into fractions of oil and gas in the towers and other processing equipment as described hereinafter.

The ebullated bed reactors are capable of handling atmospheric and vacuum resids from a wide range of sour and/or heavy crudes. Such crudes can have a gravity as low as 5° API, a sulfur content up to 8% by weight, and substantial amounts of nickel and vanadium. The ebullated bed reactors typically operate at a temperature above 700° F. and at a hydrogen partial pressure greater than 1500 psi.

Ebullated bed reactors have many advantages over fixed bed reactors. They permit operation at higher average temperatures. They permit the addition and withdrawal of catalyst without necessitating shutdown. They avoid plugging due to dirty feed and formation of solids during resid conversion.

Since the liquid resid feed does not usually have enough velocity to expand the catalyst bed above its settled level, liquid is recycled from the top of the reactor to the bottom of the reactor through a downcomer pipe and then pumped back up through the reactor at a sufficient velocity to attain the required degree of expansion.

The products produced from the resid hydrotreating units in the ebullated bed reactors include light hydrocarbon gases, light naphtha, intermediate naphtha, heavy naphtha, light distillate, mid-distillate, light gas oil, vacuum naphtha, light vacuum gas oil, heavy vacuum gas oil, and hydrotreated vacuum resid. Light and intermediate naphthas can be sent to a vapor recovery unit for use as gasoline blending stocks and reformer feed. Heavy naphtha can be sent to the reformer to produce gasoline. The mid-distillate oil is useful for producing diesel fuel and furnace oil, as well as for conveying and/or cooling the spent catalyst. Light and heavy vacuum gas oils and light gas oil are useful as feedstock for a catalytic cracker. The vacuum resid can be sent to cokers to produce coke.

As shown in FIG. 1, a relatively high sulfur resid oil feed, which can contain heavy gas oil, is conveyed by a resid feed line 86 to a heat exchanger 88 where the resid is preheated. The preheated resid is conveyed through a preheated resid line 90 to an oil heater 18 where it is heated to a temperature ranging from about 650° F. to 750° F. The heated resid feedstock is passed through a heated influent feed line 92 to an oil gas feed line 48.

Hydrogen-containing feed gas in the feed gas line 94 is fed into a hydrogen heater or feed gas heater 16 where it is heated to a temperature ranging from about 650° F. to about 900° F. The feed gas is a mixture of upgraded, methane-lean tail gases (effluent off gases) and hydrogenrich, fresh makeup gases comprising at least about 95% by volume hydrogen and preferably at least about 96% by volume hydrogen. The feed gas comprises a substantial amount of hydrogen, a lesser amount of methane, and small amounts of ethane. The heated feed gas is conveyed through the heated feed gas line 96 to the gas oil feed line 48 where it is conveyed along with the heated resid oil to the first ebullated bed reactor.

Fresh hydrotreating catalyst is fed into the first ebullated bed reactor 10 through the fresh catalyst line 46. Spent catalyst is withdrawn from the first reactor through the spent catalyst line 66. In the first reactor, the resid oil is hydroprocessed (hydrotreated), ebullated, contacted, and mixed with the hydrogen-rich feed gas in the presence of the hydrotreating catalyst at a temperature of about 700° F. to about 850° F., at a pressure of about 2650 psia to about 3050 psia, and at a hydrogen partial pressure of about 1800 psia to about 2300 psia to produce a hydrotreated (hydroprocessed), upgraded, effluent product stream. The product stream is discharged from the first reactor through the first reactor discharge line 64 and conveyed through the second reactor feed line 98 into the second ebullated bed reactor 12. A liquid quench can be injected into the product feed entering the second reactor through a liquid quench line 72. The liquid quench can be sponge oil. A gas quench can be injected into the product feed before it enters the second reactor through a gas quench line 70. The gas quench preferably comprises a mixture of upgraded, methane-lean tail gases (effluent off gases) and fresh makeup gases.

Hydrotreating catalyst, which may be removed from the third reactor, is fed into the second reactor 12 through an influent catalyst line 82. Used spent catalyst is withdrawn from the second reactor through the second spent catalyst line 84. In the second reactor, the effluent resid oil product is hydroprocessed, hydrotreated, ebullated, contacted, and mixed with the hydrogen-rich feed gas and quench gas in the presence of the hydrotreating catalyst at a temperature of about 700° F. to about 850° F., at a pressure from about 2600 psia to about 3000 psia and at a hydrogen partial pressure of about 1700 psia to about 2100 psia to produce an upgraded effluent product stream. The product stream is discharged from the second reactor through a second reactor discharge line 68.

The product feed is then fed into the third ebullated bed reactor 14 through a third reactor feed line 100. A liquid quench can be injected into the third reactor feed through an inlet liquid quench line 76. The liquid quench can be sponge oil. A gas quench can be injected into the third reactor feed through an input gas quench line 74. The gas quench can comprise upgraded, methane-lean tail gases and fresh makeup gases. Fresh hydrotreating catalyst is fed into the third reactor through a fresh catalyst line 78. Used spent catalyst is withdrawn from the third reactor through the third reactor spent catalyst line 80. In the third reactor, the resid feed is hydroprocessed, hydrotreated, ebullated, contacted, and mixed with the hydrogen-rich gas in the presence of the hydrowith treating catalyst at a temperature from about 700° F. to about 850° F., at a pressure of about 2550 psia to about 2950 psia and at a hydrogen partial pressure from about 1600 psia to about 2000 psia to produce an upgraded product stream. The product stream is withdrawn from the third reactor through the third reactor discharge line 102 and fed into a high-temperature, high-pressure separator 104 via inlet line 106. A gas quench can be injected into the product stream in the inlet line through a gas quench line 108 before the product stream enters the high-temperature separator. The gas quench can comprise upgraded, methane-lean tail gases and fresh makeup gases.

The upgraded effluent product streams discharged from the reactors comprise hydrotreated resid oil and reactor tail gases (effluent off gases). The tail gases comprise hydrogen, hydrogen sulfide, ammonia, water, methane, and other light hydrocarbon gases, such as ethane, propane, butane, and pentane.

EXAMPLE 1

In a series of tests, the train of three ebullated bed reactors were operated under the previously described operating conditions. The effluent reactor tail gases comprised about:

| Gas | % (Volume) |
|---|---|
| Hydrogen | 60 |
| Hydrogen Sulfide | 2–5 |
| Methane and Other Light Hydrocarbon Gases | 15–35 |
| Ammonia | 0.5–1 |

In the high-temperature (HT) separator 104, the hydrotreated product stream is separated into a bottom stream of high-temperature, hydrotreated, heavy resid oil liquid and an overhead stream of gases and hydrotreated oil vapors. The high-temperature separator is operated at a temperature of about 700° F. to about 850° F. and at a pressure from about 2500 psia to about 2900 psia. The overhead stream of gases and oil vapors is withdrawn from the high-temperature separator through an overhead line 110. The bottom stream of high-temperature heavy oil liquid is discharged from the bottom of the high-temperature separator through a high-temperature separator bottom line 112 and fed to a high-temperature flash drum 114.

In the high-temperature flash drum 114, the influent stream of heavy oil liquid is separated and flashed into a stream of high-temperature vapors and gases and an effluent stream of high-temperature, heavy oil liquid. The effluent, high-temperature, hydrotreated, heavy resid oil liquid is discharged from the bottom of the flash drum through the high-temperature, flash drum bottom line 116 and fed into an atmospheric tower 20. The high-temperature flash gas and vapors are withdrawn from the hightemperature flash drum through a high-temperature, flash drum overhead line 120 and are conveyed, blended, and intermixed with medium-temperature overhead flash vapors from the medium-temperature (MT) flash drum overhead line 122 through a combined, common flash line 124. The combined flash gas and vapors are optionally cooled in one or more heat exchangers or coolers 126 before being conveyed through a line 128 to the low temperature (LT) flash drum 130.

In the LT flash drum 130, the influent high-temperature flash gases and vapors are separated into low-pressure gases and light oil liquid. The low-pressure gases are withdrawn from the LT flash drum through an outlet gas line 132 and conveyed downstream to the makeup gas system for use as sweet fuel. The light oil liquid is discharged from the LT flash drum through a light oil line 134 and is conveyed, blended, and intermixed with medium-temperature, light oil liquid from the medium-temperature, flash drum light oil line 136 in a combined, common light oil line 138. The combined medium-temperature, light oil liquid is heated in a furnace 140 and conveyed through a light oil feed line 142 to the atmospheric tower.

In the atmospheric tower 20, the hydrotreated, high-temperature, heavy oil liquid from the high-temperature, flash drum effluent oil line 116 and the hydrotreated, medium-temperature, light oil liquid from the medium-temperature oil line 142 are separated into fractions of light and intermediate naphtha, heavy naphtha, light distillate, mid-distillate, light atmospheric gas oil, and atmospheric hydrotreated resid oil. Light and intermediate naphtha is withdrawn from the atmospheric tower through an unstable naphtha line 144. Heavy naphtha is withdrawn from the atmospheric tower through a heavy naphtha line 146. Light distillate is withdrawn from the atmospheric tower through a light distillate line 148. Mid-distillates are withdrawn from the atmospheric tower through a mid-distillate line 150. Light atmospheric gas oil is withdrawn from the atmospheric tower through a light atmospheric gas oil line 152. Atmospheric resid oil is discharged from the bottom portion of the atmospheric tower through the atmospheric resid line 154 and heated in an atmospheric resid oil heater 24 before being conveyed through a vacuum tower feed line 158 to the vacuum tower 22.

In vacuum tower 22, the atmospheric influent, hydrotreated resid oil is separated into gases, vacuum naphtha, light vacuum gas oil, heavy vacuum gas oil, and hydrotreated, vacuum resid oil or vacuum resid. The gases are withdrawn from the vacuum tower through an overhead vacuum gas line 162. Vacuum naphtha is withdrawn from the vacuum tower through a vacuum naphtha line 164. Light vacuum gas oil (LVGO) is withdrawn from the vacuum tower through a light vacuum gas oil line 166. Heavy vacuum gas oil (HVGO) is withdrawn from the vacuum tower through a heavy vacuum gas oil line 168. Vacuum resid oil is withdrawn from the bottom of the vacuum tower through a vacuum resid discharge line 169 and fed to a coker or used for fuel oil products.

Referring again to the high-temperature separator 104 (FIG. 1), high-temperature gases and oil vapors are withdrawn from the high-temperature separator 104 through an overhead vapor line 110 and cooled in a resid feed heat exchanger 88 which concurrently preheats the resid oil feed in line 86 before the resid oil feed enters the oil heater 18. The cooled vapors and gases exit the heat exchanger 88 and are passed through an intermediate line 170 and cooled in a high-temperature gas quench heat exchanger 172 which concurrently preheats the feed gas before the feed gas passes through the hydrogen heater inlet line 94 into the hydrogen heater 16. The cooled gases and vapors exit the heat exchanger 172 and are passed through a medium-temperature inlet line 174 to a medium-temperature, high-pressure separator 176.

In the medium-temperature (MT) separator 176, the influent gases and oil vapors are separated at a temperature of about 500° F. and at a pressure of about 2450 psia to about 2850 psia into medium-temperature gases and hydrotreated, medium-temperature liquid. The medium-temperature gases are withdrawn from the MT separator through a medium-temperature gas line 178. The medium-temperature liquid is discharged from the bottom of the MT separator through a medium-temperature liquid line 180 and conveyed to a medium-temperature flash drum 182.

In the medium-temperature (MT) flash drum 182, the influent medium-temperature liquid is separated and flashed into medium-temperature vapors and effluent medium-temperature, hydrotreated liquid. The medium-temperature flash vapors are withdrawn from the MT flash drum through a medium-temperature overhead line 122 and injected, blended, and mixed with the high-temperature overhead flash gases and vapors in the combined, common flash line 124 before being cooled in heat exchanger 126 and conveyed to the LT flash drum 130. The effluent medium-temperature liquid is discharged from the MT flash drum through a light oil discharge line 136 and is injected, blended, and mixed with the low-temperature liquid from the LT flash drum in combined, common light oil liquid line 138 before being heated in the light oil heater 140 and conveyed to the atmospheric tower 20.

In the MT separator 176, the medium-temperature effluent gases exit the MT separator through an MT gas line 178 and are cooled in a medium-temperature (MT) feed gas heat exchanger 180 which also preheats the feed gas before the feed gas is subsequently heated in the HT heat exchanger 172 and the hydrogen heater 16. The cooled medium-temperature gases exit the MT heat exchanger 180 through a medium-temperature (MT) gas line 182 and are combined, blended and intermixed with compressed gas from an anti-surge line 184 in a combined, common gas line 186. The gas and vapors in gas line 186 are blended, diluted, and partially dissolved with wash water, pumped by the water pump 188 through a water line 190, in a combined water gas inlet line 192. Ammonia and hydrogen sulfide in the tail gases react to form ammonium bisulfide which dissolves in the injected water. The gas and water products in line 192 are cooled in an air cooler 36 and conveyed through a sponge absorber feed line 196 into a sponge oil absorber and low-temperature (LT) separator 44.

Lean sponge oil is fed into the sponge oil absorber 44 through a lean sponge oil line 200. In the sponge oil absorber, the lean sponge oil and the influent tail gases are circulated in a countercurrent extraction flow pattern. The sponge oil absorbs, extracts, and separates a substantial amount of methane and ethane and most of the $C_3$, $C_4$, $C_5$, and $C_6$+ light hydrocarbons (propane, butane, pentane, hexane, etc.) from the influent product stream. The sponge oil absorber operates at a temperature of about 130° F. and at a pressure of about 2700 psia. The effluent gases comprising hydrogen, methane, ethane, and hydrogen sulfide are withdrawn from the sponge oil absorber through a sponge oil effluent gas line 202 and fed into a highpressure (HP) amine absorber 204.

Effluent water containing ammonium bisulfide is discharged from the bottom of the sponge oil absorber 44 through an effluent water line 206 and conveyed to a sour water flash drum, a sour water degassing drum, and/or other wastewater purification equipment and recycled or discharged.

Rich sponge oil effluent containing $C_3$, $C_4$, $C_5$, and $C_6$+ absorbed light hydrocarbons is discharged from the bottom portion of the sponge absorber 44 through a rich sponge oil line 208 and conveyed to a sponge oil flash drum 40. Vacuum naphtha and/or middle distillate can also be fed into the sponge oil (SO) flash drum through a sponge oil-naphtha line 212 as a stream to keep a level in the sponge oil system. In the sponge oil flash drum 40, the rich sponge oil is flashed and separated into light hydrocarbon gases and lean sponge oil. The flashed light hydrocarbon gases are withdrawn from the SO flash drum through a gas line 214 and conveyed downstream for further processing. Lean sponge oil is discharged from the SO flash drum through a lean sponge oil discharge line 216 and pumped (recycled) back to the sponge oil absorber via sponge oil pump 218 and line 200. Some of the lean sponge oil can also be used as the liquid quench.

The ammonia-lean, $C_3$+ lean reactor tail gases containing hydrogen sulfide, hydrogen, methane, and residual amounts of ethane are fed into the high pressure (HP) amine absorber 204 through an amine absorber inlet line 202. Lean amine from the sulfur recovery unit (SRU) lean amine discharge line 220 is pumped into the HP amine absorber 204 by a lean amine pump 222 through a lean amine inlet line 224. In the HP amine absorber 204, lean amine and influent tail gases are circulated in a coutercurrent extraction flow pattern at a pressure of about 2500 psia. The lean amine absorbs, separates, extracts, and removes substantially all the hydrogen sulfide from the influent tail gases.

Rich amine containing hydrogen sulfide is discharged from the bottom of the HP amine absorber 204 through a rich amine line 226 and conveyed to a low-pressure (LP) amine absorber 228. The lean amine from the sulfur recovery unit is recycled back to the high-pressure and lowpressure amine absorbers through the lean amine line. Skimmed oil recovered in the HP amine absorber 204 is discharged from the bottom of the HP amine absorber through a high-pressure (HP) skimmed oil line 230 and passed to the LP amine absorber 228. Lean amine from the sulfur recovery unit (SRU) is also pumped into the LP amine absorber 228 through a LP lean amine inlet line 232.

In the LP amine absorber 228, the influent products are separated into gases, rich amine, and skimmed oil. Gases are withdrawn from the LP amine absorber 228 through a gas line 234 and conveyed downstream through line 236 for use as sweet fuel or added to the fresh makeup gas through auxiliary gas line 238. Rich amine is discharged from the LP amine absorber 228 through a rich amine discharge line 240 and conveyed to a sulfur recovery unit (SRU) 242. Skimmed oil can also be withdrawn from the LP amine absorber and conveyed to the SRU through line 240 or a separate line. The sulfur recovery unit can take the form of a Claus plant, such as the type shown in FIG. 5, although other types of sulfur recovery units can also be used.

Figure 4:
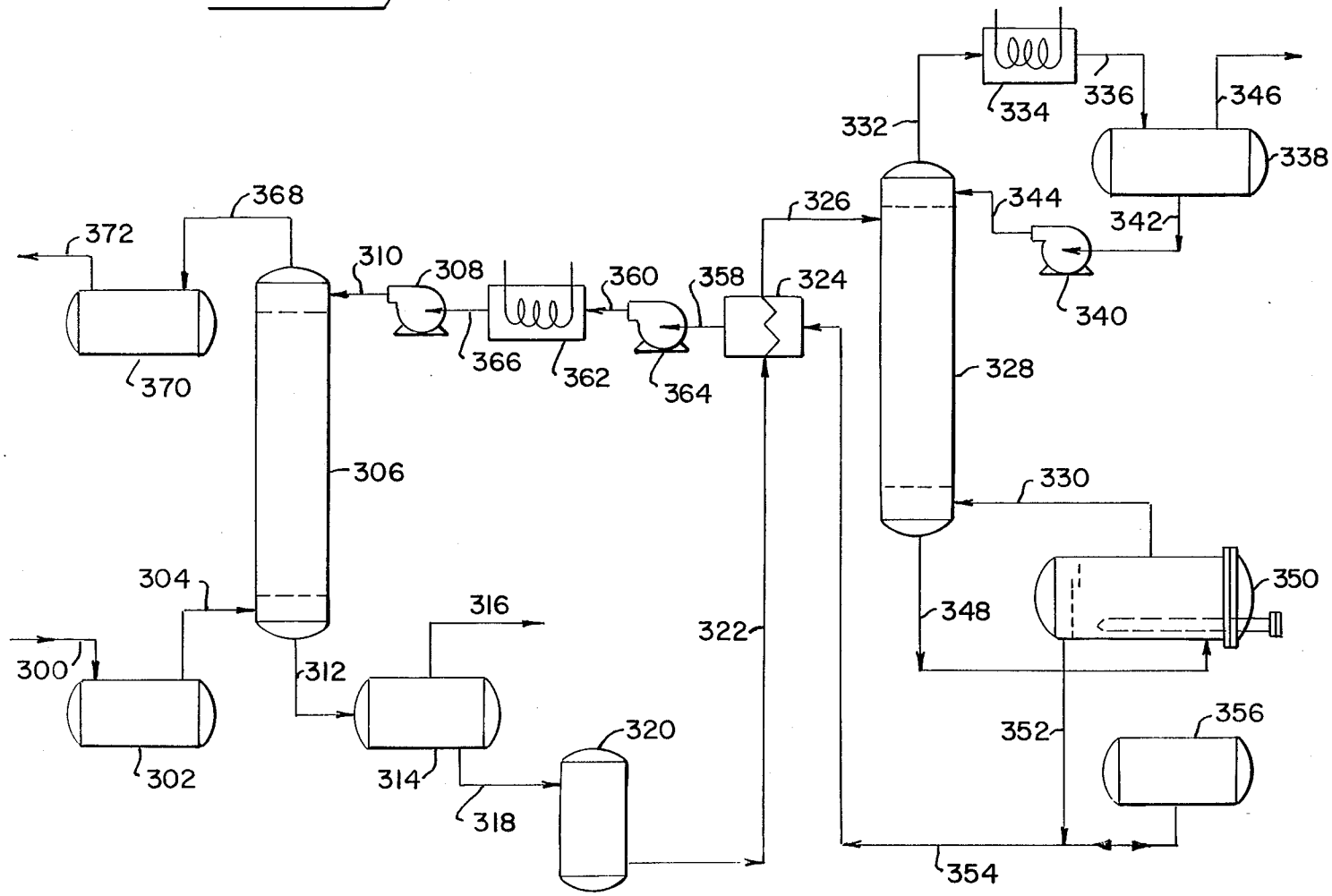
FIG. 4 is a schematic flow diagram of an amine recovery unit.

The amine recovery unit includes the HP and LP amine absorbers and can take the form shown in FIG. 4, although other types of amine recovery units can be used, if desired.

The amine recovery unit preferably decreases the concentration of hydrogen sulfide in the waste gas stream to less than 1 part per cubic foot of gas. DEA (diethanolamine) is preferred over MEA (monoethanolamine) because of degradation of MEA by carbonyl sulfide and carbon disulfide in the gases. Although the invention is not to be so limited, it is believed that DEA amine solutions will absorb both hydrogen sulfide ($H_2S$) and carbon dioxide ($CO_2$) according to the following reaction:

$$R_2NH + H_2S \rightleftharpoons R_2NH_2HS$$

$$CO_2 + R_2NH + H_2O \rightleftharpoons R_2NH_2HCO_3$$

The amine desulfurization process which occurs in the amine recovery unit involves contacting the sour sulfur-containing gas stream (waste gases) with a cool DEA amine solution to absorb the hydrogen sulfide and then regenerating the amine and stripping the hydrogen sulfide from the amine solution by heating.

In the amine recovery unit of FIG. 4, sour waste gases (acid gases) in waste gas line 300 are fed to an inlet scrubber 302 which removes (scrubs) entrained liquids, including distillate and water, from the waste gases. The scrubbed gases are discharged from the inlet scrubber through scrubber discharge line 304 and fed to the bottom portion of a contactor or absorber column 306. A DEA amine feed is pumped into the top portion of the absorber column by amine charge pump 308 via an amine feed line 310. In the absorber column, the scrubbed waste gases are contacted in countercurrent flow relationship with the amine feed to react the hydrogen sulfide and the carbon dioxide in the waste gases with the amine. The absorber column can be a trayed or packed tower and provides gas-liquid contact.

Rich amine is discharged from the bottom of the absorber column 306 (FIG. 4) through a rich amine line 312 and fed to a flash tank 314 where it is flashed at a reduced pressure to remove entrained gases through an entrained gas line 316. The flashed rich amine gases are discharged from the bottom of the flash tank through a discharge line 318 and fed to and filtered in a carbon filter 320. The filtered rich amine is fed through a filtered amine line 322 to a rich/lean amine heat exchanger 324 where the rich amine is heated. The heated rich amine is discharged from the heat exchanger through a heated rich amine line 326 and fed into the upper portion of a stripper column, steam stripper, or still 328.

Steam is injected into the lower portion of the steam stripper 328 (FIG. 4) through a steam injection line 330. In the steam stripper, the rich amine solution is regenerated and stripped of acid gases by the steam. The concentrated acid gases are withdrawn from the steam stripper through overhead acid gas line 332 and cooled in a water cooler or condenser 334. The cooled acid gases are passed through cooled acid gas line 336 and collected in a reflux accumulator 338. Part of the concentrated acid gases in the reflux accumulator can be recycled, refluxed, and pumped into the upper portion of the steam stripper (stripper column) 328 by reflux pump 340 via reflux lines 342 and 344. The excess acid gases can be discharged from the reflux accumulator through excess gas line 346 and processed downstream or sent to a sulfur recovery unit, such as a Claus plant.

The stripped rich amine is discharged from the bottom of the steam stripper 328 (FIG. 4) through a stripped amine line 348 and fed into a reboiler, 350. Steam is boiled out of the amine in the reboiler and withdrawn through overhead steam line 330 where it is injected into the lower portion of the steam stripper 328. The residual boiled lean amine is discharged from the reboiler through a lean amine discharge line 352 and passed through a lean amine line 354 to a heat exchanger 324. The inventory of the lean amine in the amine line 354 is controlled by a surge tank 356.

Lean amine exits the heat exchanger 324 (FIG. 4) through an outlet line 358 and is pumped through line 360 to a cooler or heat exchanger 362 by a booster pump 364. The lean amine solution is cooled in the heat exchanger 362. The cooled amine is discharged from the heat exchanger 362 through a cooled amine line 366 and pumped through a lean amine feed line 310 into the upper portion of the absorber column 306 by the amine charge pump 308.

Effluent gases are withdrawn from the absorber column 306 (FIG. 4) through an overhead gas line 368 and fed to an outlet scrubber 370. The outlet scrubber scrubs the gases from the gas line 368 to recover any residual amine solution carried over in the effluent gases. The sweet scrubbed gases are discharged from the outlet scrubber ( 20 through sweet gas line 372.

Figure 5:
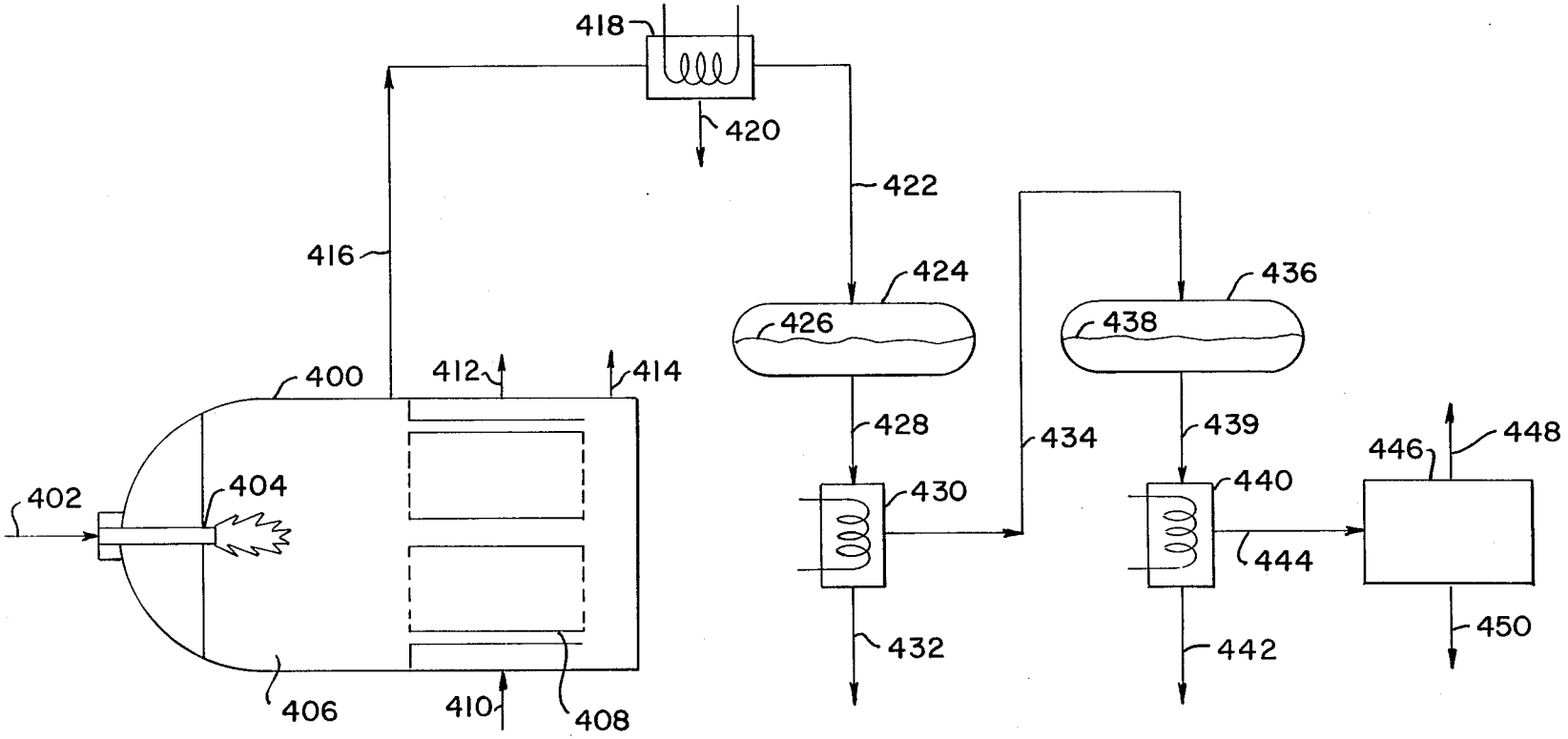
FIG. 5 is a schematic flow diagram of a sulfur recovery unit.

Acid waste gases are fed to a sulfur recovery unit and scavenger plant, preferably a Claus plant, such as the type shown in FIG. 5. The Claus plant can recover 99.0% or more of the elemental sulfur in the influent acid gases.

As shown in FIG. 5, in a typical Claus plant, acid gases enter an oxidation unit and waste-heat boiler 400 through an acid gas inlet line 402. In the oxidation unit, about one-third of the hydrogen sulfide ($H_2S$) in the acid gases is oxidized to sulfur dioxide ($SO_2$) and water by the reaction:

$$H_2S + 3/2\ O_2 \rightarrow SO_2 + H_2O$$

The reaction furnace section 406 (FIG. 5) of the unit 400 is downstream of the burner 404 and provides a thermal region in which about 70% by weight of the hydrogen sulfide ($H_2S$) of the remaining acid gases and the sulfur dioxide ($SO_2$) is converted to elemental molecular sulfur and water or steam in accordance with the following endothermic reaction:

$$2H_2S + SO_2 \rightarrow 3/2\ S_2 + 2H_2O$$

Water is fed into the boiler section 408 (FIG. 5) of the unit 400 through water line 410. The hot reaction gases in the reaction furnace, which can be at a temperature such as 2,300° F., are cooled by the water in the water pipes of the boiler section to a much cooler temperature, such as 1,100° F. The water in the water pipes of the boiler section is boiled and heated by the hot reaction gases and converted to steam. Steam is removed from the boiler section through steam line 412. In the boiler section, the elemental sulfur is converted to $S_6$ and $S_8$ in accordance with the following exothermic reactions:

$$S_2 \rightarrow \tfrac{1}{3}\ S_6 \text{ and } S_2 \rightarrow \tfrac{1}{4}\ S_8$$

Hot gases containing $S_6$ and $S_8$ are withdrawn from the unit through gas bypass line 414.

The partially stripped reaction gases are removed from the unit 400 (FIG. 5) through outlet gas line 416. The stripped reaction gases typically contain hydrogen sulfide ($H_2S$), sulfur dioxide ($SO_2$), elemental sulfur ($S_2$), nitrogen ($N_2$), carbonyl sulfide (COS), carbon disulfide ($CS_2$), and steam. The stripped reaction gases can be withdrawn from the unit through gas line 416 at a temperature ranging from 550° F. to 600° F. The stripped reaction gases in the gas line 416 are fed to a heat exchanger 418 to cool the reaction gases to about 530° F. and condense or precipitate some of the sulfur. The condensed or precipitated sulfur is removed from the heat exchanger through sulfur line 420.

The cooled reaction gases are withdrawn from the heat exchanger 418 (FIG. 5) through cooled gas line 422 and fed to a first Claus converter 424. The bottom portion of the converter contains a fixed catalyst bed 426. The reaction gases are passed through the fixed catalyst bed in the first converter to catalytically react the remaining hydrogen sulfide ($H_2S$) with the sulfur dioxide ($SO_2$) to form water and free sulfur. The products are heated by the catalytic reaction to over 650° F. The reaction products are discharged from the first converter through discharge line 428 and cooled in a cooler or heat exchanger 430 to condense, precipitate, and/or recover more sulfur. The sulfur is removed from the heat exchanger through sulfur recovery line 432.

The cooled reaction gases, which can be cooled to below 400° F., are withdrawn from the heat exchanger 430 through cooled reaction gas line 434 and fed to a second Claus converter 436. The second Claus converter also has a fixed catalyst bed 438. The reaction products are passed through the catalyst bed 438 to catalytically react the remaining hydrogen sulfide ($H_2S$) with the sulfur dioxide ($SO_2$) to form water and free sulfur. The resulting reaction products are heated to a temperature slightly below 500° F. by the reaction in the second converter. The reaction products are discharged from the second converter through reaction product outlet line 439 and cooled in a cooler or heat exchanger 440 to condense, precipitate, and/or remove substantially all of the remaining sulfur.

The sulfur is removed from the heat exchanger 440 (FIG. 5) through sulfur recovery line 442. The cooled tail gases are withdrawn from the heat exchanger 440 through tail gas outlet line 444 and passed to tail gas cleanup equipment 446, such as Beavon and Stretford processing equipment, to clean up the tail gases. The sweet cleansed tail gases are withdrawn from the tail gas cleanup equipment through sweet gas line 448. Sulfur recovered from the tail gases are removed from the tail gas cleanup equipment through sulfur recovery line 450.

While the above two-stage Claus plant is preferred because it recovers at least 95% elemental sulfur, other types of Claus plants can be used, if desired, such as a split-stream Claus plant, a partial-oxidation Claus plant, or an ultra three-stage Claus plant.

In the HP amine absorber 204 of FIG. 1, the lean amine influent absorbs, separates, extracts and removes hydrogen sulfide from the influent stream leaving upgraded reactor tail gases (off gases). The upgraded reactor tail gases comprise about 70% to about 80% by volume hydrogen and about 20% to 30% by volume methane, although residual amounts of ethane may be present. The upgraded reactor tail gases are withdrawn from the high-pressure amine absorber through an overhead, upgraded tail gas line 250 and conveyed to a recycle compressor 252. The recycle compressor increases the pressure of the upgraded tail gases. The compressed tail gases are discharged from the compressor through a compressor outlet line 254. Part of the compressed gases can be passed through an antisurge line 184 and injected into the combined gas line 186 to control the inventory, flow and surging of medium-temperature gases being conveyed to the sponge oil absorber 44. Other portions of the gases prior to compression can be bled off through a bleed line or spill line 256 and used for fuel gas or for other purposes as discussed below.

Fresh makeup gases comprising at least about 95% hydrogen, preferably at least 96% hydrogen, by volume, from a hydrogen plant are conveyed through fresh makeup gas lines 258, 260, and 262 (FIG. 1) by a makeup gas compressor 264, along with gas from gas line 238, and injected, mixed, dispersed, and blended with the main portion of the compressed upgraded tail gases in a combined, common feed gas line 266. The ratio of fresh makeup gases to compressed recycle tail gases in the combined feed gas line 266 can range from about 1:2 to about 1:4.

About 10% by volume of the blended mixture of compressed, upgraded, recycled reactor tail gases (upgraded effluent off gases) and fresh makeup hydrogen gases in combined feed gas line 266 are bled off through a quench line 268 for use as quench gases. The quench gases are injected into the second and third ebullated bed reactors through the second reactor inlet quench line 70 and the third reactor inlet quench line 74 and are injected into the effluent hydrotreated product stream exiting the third reactor through quench line 108.

The remaining main portion, about 90% by volume, of the blended mixture of compressed, upgraded, recycled, reactor tail gases (upgraded off gases) and fresh makeup gases in the combined feed gas line 266 comprise the feed gases. The feed gases in the combined feed gas line 266 are preheated in a medium-temperature (MT) heat exchanger 180 (FIG. 1) and passed through a heat exchanger line 270 to a high-temperature (HT) heat exchanger 172 where the feed gases are further heated to a higher temperature. The heated feed gases are discharged from the HT heat exchanger 172 through a discharge line 94 and passed through a hydrogen heater 16 which heats the feed gases to a temperature ranging from about 650° F. to about 900° F. The heated hydrogen-rich feed gases exit the hydrogen heater 16 through a feed gas line 96 and are injected (fed) through an oil-gas line 48 into the first ebullated bed reactor.

It was unexpectedly and surprisingly found during extensive tests in the Amoco Oil Company Refinery at Texas City, Tex., that the conversion of the 1000+° F. resid (resid feed oil) to more valuable lower-boiling liquid products could be significantly and substantially increased without substantially increasing catalyst coke formation (coke deposition) or loss of product yield and quantity, by substantially reducing the feed gas rate while maintaining the hydrogen partial pressures in the reactors by simultaneously increasing the amount of hydrogen (hydrogen concentration and purity) in the feed gases and quench gases.

In order to increase the hydrogen concentration (purity) of the feed gases, a greater portion of the light hydrocarbon gases in the reactor tail gases are removed by the sponge absorber 44 (FIG. 1). This is accomplished by increasing the flow rate (circulation rate) of the influent lean sponge oil with the sponge oil pump 218 from about 2.75 to about three times the initial flow rate of the lean sponge oil feed rate being fed into the sponge oil absorber.

EXAMPLE 2

In a series of tests, the feed rate of the influent lean sponge oil fed into the sponge oil absorber was increased from an initial feed rate range of 8000 to 10,000 barrels per day to 22,000 to 30,000 barrels per day. This procedure increased the hydrogen concentration in the feed gases and quench gas to about 84%–85% by volume.

Concurrently, the feed rates of the feed gases into the reactors were decreased by about 15% to about 25% while maintaining both the hydrogen partial pressures and hydroprocessing temperatures in the reactors in order to minimize catalyst coke deposition in the ebullated bed reactors.

EXAMPLE 3

During extensive testing at the Amoco Oil Company Refinery at Texas City, TX, the feed gas rate in the ebullated bed reactors was lowered from an initial flow rate ranging from 3 to 3.25 MMSCFH (million standard cubic feet per hour) to about 2.4 to 2.75 MMSCFH under the conditions of Example 2. Resid conversion increased 4 to 6%.

In order to increase the concentration (purity) of the hydrogen in the feed gases to at least about 86% by volume, it is desirable to bleed, spill, or remove some of the compressed, upgraded, reactor tail gases (upgraded recycled gases) by withdrawing a portion of the upgraded recycled gases through the bleed line 256 (FIG. 1). The withdrawn (bled) gases can be used as a fuel gas, such as for firing the hydrogen heater, oil heater, atmospheric charge heater, vacuum charge heater, or hot oil heater.

Fresh, makeup hydrogen-rich gases, containing at least about 95% by volume hydrogen, and preferably at least 96% by volume hydrogen, are compressed, injected, and/or added to the feed gas in combined feed gas line 266 (FIG. 1) by the fresh makeup gas compressor 264, via injection line 262, to replace the compressed recycled gases which have been bled, spilled, and/or removed through the bleed line 256 in order to attain the desired gas balance and increase the concentration (purity) and proportion of hydrogen in the feed gases. Preferably, the ratio of fresh makeup gases to spilled (bled) recycled gases is about 1:1.

EXAMPLE 4

In one test, 61 MSCFH of compressed recycled gases were spilled and removed from a resid hydrotreating system similar to that in FIG. 1 through a bleed line 256 and 61 MSCFH of fresh makeup gases containing 96% hydrogen by volume were added to the feed gas through a fresh makeup line 258 to formulate feed gases comprising 86% by volume hydrogen.

It was unexpectedly and surprisingly found that increasing the concentration of hydrogen in the feed gas while concurrently decreasing the feed gas rate into the reactors as described above increases the conversion of the resid feed to more valuable lower-boiling liquid products by about 4% to 10% and preferably at least 6%. Such an increase represents a substantial improvement in the profitability, efficiency, and effectiveness of commercial resid hydrotreating units, such as those which operate at 60,000 to 75,000 barrels of oil per day.

Applicants' novel resid hydrotreating process achieved unexpected, surprisingly good results. The resid hydrotreating process increased the production of $C_5$-360° F. naphtha (gasoline) in the atmospheric and the vacuum towers by about 1% to 3% by weight, and usually by at least about 2%. Applicants' resid hydrotreating process increased the production of 366° F. to 650° F. distillates (kerosene, diesel oil, etc.) in the atmospheric tower by about 2.5% to 5.5% by weight, and usually by at least 3%. The resid hydrotreating process increased the production of $C_1$–$C_4$ light hydrocarbon gases by 0.5% to 1.5% by volume and usually by about 1%. Desirably, the resid hydrotreating process also decreases the production of less valuable vacuum resid oil from the vacuum tower and decreases the production of less valuable atmospheric resid oil from the atmospheric tower by about 4% to 10% by weight and usually by at least 6%.

Gas oil production remained about the same in the resid hydrotreating process because some of the gas oil was converted to lighter products even though part of the resid was being upgraded to gas oil.

The resid hydrotreating process decreases gas holdup in the reactors while increasing the usable volume in the reactors for hydrotreating the resid. The resid hydrotreating process can be operated to attain resid conversions of at least 40% to 90%.

EXAMPLE 5

A resid hydrotreating process similar to that of FIG. 1 was studied under the conditions of Example 3 at a 40% conversion level (i.e. 40% of the influent resid feed was converted to more valuable lower-boiling hydrocarbons). The following product slate was produced.

| Product | % |
|---|---|
| $C_1$–$C_4$ Light Hydrocarbon Gases | 1.7 by weight |
| $C_5$-360° F. Naphtha | 4.1 by weight |
| 366° F.–650° F. Distillates | 13.7 by weight |
| 350° F.–1000° F. Gas Oil | 27.0 by weight |
| 1000 + °F. Resid | 52.0 by weight |

EXAMPLE 6

A resid hydrotreating process similar to that of FIG. 1 was studied under the conditions of Example 5 but at a lower throughput at a 90% conversion level (i.e. 90% of the influent resid feed was converted to more valuable lower-boiling hydrocarbons). The following product slate was produced.

| Product | % |
|---|---|
| $C_1$–$C_4$ Light Hydrocarbon Gases | 6.8 by weight |
| $C_5$-360° F. Naphtha | 18.4 by weight |
| 366° F.–650° F. Distillates | 42.0 by weight |
| 350° F.–1000° F. Gas Oil | 22.0 by weight |
| 1000 + °F. Resid | 9.0 by weight |

EXAMPLE 7–10

The flow rate (feed rate) of the feed gases of Example 3 was decreased from 3.25 to 2.5 MMSCFH while maintaining the hydrogen partial pressure and hydroprocessing temperatures in the reactors. The results showed that the concentration (purity) or proportion of hydrogen in the feed gas increased and that the thermal-to-catalytic (T/C) ratio increased as follows:

| Example | 7 | 8 | 9 | 10 |
|---|---|---|---|---|
| Feed Rate (MMSCFH) | 3.25 | 3.00 | 2.75 | 2.50 |
| Thermal-to-Catalytic (T/C) Ratio | .62 | .69 | .76 | .84 |
| Concentration of Hydrogen in the Feed Gas (Volume %) | 80.6 | 81.7 | 83.6 | 85.7 |

EXAMPLES 11–12

The feed rate of the influent lean sponge oil into the sponge oil absorber 44 (FIG. 1) was increased from 8 MB/D (thousand barrels per day) to 23.5 MB/D without substantially changing the hydrogen partial pressures and hydroprocessing temperatures in the ebullated bed reactors 10, 12, and 14. About 70 MSCFH of the compressed recycled tail gases were spilled through the bleed line 256 and madeup (compensated) by about 70 MSCFH of fresh makeup gases containing about 93.8% hydrogen by volume. The concentration of hydrogen in the feed gas was raised from about 80.2% to 85.9% by volume. The feed gas rate to the ebullated bed reactors was decreased from 3.25 to 2.5 MMSCFH. As a result, gas holdup was reduced by about 15%; resid conversion increased about 4.7%; and the thermal-to-catalytic (T/C) ratio increased to about 1.15. Other unit data and results were as follows:

| Process Condition | Example 11 | Example 12 |
|---|---|---|
| Lean Sponge Oil Feed Rate (MB/D) | 8 | 23.5 |
| Feed Gas Rate (MMSCFH) | 3.25 | 2.50 |
| Resid Feed Rate (MB/D) | 18.8 | 18.8 |
| Hydrogen Concentration in the Feed Gas (% by volume) | 80.2 | 85.9 |
| Makeup Gas Rate (MMSCFH) | 1.06 | 1.26 |

-continued

| Process Condition | Example 11 | Example 12 |
|---|---|---|
| Recycled Gas Spillage (MSCFH) | 0 | 70 |
| Effluent Sponge Oil Flash Gas (MSCFH) | 78.3 | 99.2 |
| Compressor Steam Rate (ML/hr) | 7.75 | 6.50 |
| Reactor Temperature (°F.) | 790.0 | 790.5 |
| Resid Conversion % by Weight | 59.5 | 64.2 |

Among the many advantages of the resid hydrotreating process are:

1. Increased conversion of the 1000+° F. resid to more valuable lower boiling, hydrocarbons.
2. Superior process efficiency.
3. Improved resid conversion effectiveness.
4. Increased product yield
5. Better product quality.
6. Improved operability.
7. Enhanced economy and profitability.
8. Good Ramscarbon removal.
9. Excellent desulfurization.
10. Good demetalation.
11. Increased thermal-to-catalytic (T/C) ratio.
12. Decreased gas holdup.
13. Lower steam requirments to the compressor.
14. Greater hydrogen uptake by the product oil.

Although embodiments of this invention have been shown and described, it is to be understood that various modifications and substitutions, as well as rearrangements and combinations of process steps and equipment, can be made by those skilled inthe art without departing from the novel spirit and scope of this invention.

What is claimed is

1. A resid conversion process, comprising the steps of:

feeding relatively high sulfur resid oil to a reactor train comprising a series of three ebullated bed reactors;

conveying a catalyst to said reactor train;

injecting feed gases comprising hydrogen and methane into said ebullated bed reactors;

converting said resid oil to lower boiling liquid products by contacting and ebullating said resid oil in said reactor train of three ebullated bed reactors with said feed gases in the presence of said catalyst at a temperature ranging from about 700° F. to about 850° F. at a pressure ranging from about 2,550 psia to about 3,050 psia, at a hydrogen partial pressure ranging from about 1,600 psia to about 2,300 psia, to produce an upgraded product stream containing upgraded resid oil and effluent tail gases comprising hydrogen, hydrogen sulfide, ammonia, water, methane and other light hydrocarbon gases;

substantially separating said upgraded resid oil from said effluent tail gases in at least one separator; thereafter feeding said separated upgraded resid oil to an atmospheric tower;

separating said separated upgraded resid oil in said atmospheric tower into at least one stream of naphtha, at least one stream of distillate, a stream of atmospheric gas oil, and a stream of atmospheric resid oil;

feeding said atmospheric resid oil to a vacuum tower;

separating said atmospheric resid oil in said vacuum tower into an overhead stream of vacuum gases, a stream of vacuum naphtha, at least one stream of vacuum gas oil, and a bottom stream of vacuum resid oil;

cooling said effluent tail gases;

reacting said effluent tail gases with water to form soluble ammonium bisulfide;

conveying said water-reacted tail gases containing ammonium bisulfide to a sponge oil absorber;

feeding lean sponge oil at an initial sponge oil flow rate to a sponge oil absorber;

extracting a substantial amount of light hydrocarbon gases from said water-reacted tail gases in said sponge oil absorber with said lean sponge oil to form sponge oil effluent gases and rich sponge oil;

withdrawing said ammonium bisulfide from said sponge oil absorber;

discharging said rich sponge oil from said sponge oil absorber;

separating light hydrocarbon gases from said rich sponge oil to produce lean sponge oil and recycling said lean sponge oil to said sponge oil absorber;

conveying said sponge oil effluent gases to an amine absorber;

feeding lean amine to said amine absorber;

absorbing a substantial amount of hydrogen sulfide from said sponge oil effluent gases with said lean amine in said amine absorber to produce upgraded effluent tail gases comprising about 70% to about 80% by volume hydrogen and about 20% to about 30% by volume methane;

substantially increasing the flow rate of lean sponge oil into the sponge oil absorber to substantially increase the concentration of hydrogen in said feed gases to at least about 84% by volume;

compressing said upgraded tail gases to increase the hydrogen partial pressure of said upgraded tail gases;

recycling said compressed gases to said reactors as part of said feed gas;

blending said compressed gases with fresh makeup gases comprising at least about 95% by volume hydrogen to form said feed gases; and increasing the conversion of said resid oil to lower boiling liquid products in said train of three ebullated bed reactors by about 4% to about 10% by decreasing the feed rate of said feed gases into said train of three ebullated bed reactors by about 15% to about 25% while simultaneously producing said upgraded tail gases with said lean amine and increasing the flow rate of lean sponge oil to said sponge oil absorber to produce at least 84% by volume hydrogen in said feed gases; and while simultaneously substantially maintaining the hydrogen partial pressure and said temperature in said reactors.

2. A resid conversion process in accordance with claim 1 wherein said hydrotreated oil is separated from said effluent gases in a high-temperature separator and medium-temperature separator, said oil from said high-temperature separator comprising heavy oil, and said oil from said medium-temperature separator comprising medium-temperature oil.

3. A resid conversion process in accordance with claim 2 wherein high-temperature vapors are separated from said heavy oil in high-temperature flash drum and medium-temperature vapors are separated from said medium-temperature oil in a medium-temperature flash drum.

4. A resid conversion process in accordance with claim 1 including feeding quench gases comprising less than 20% by volume of said blended gases to said second and third ebullated bed reactors.

5. A resid conversion process in accordance with claim 1 wherein said flow rate of said lean sponge oil is increased by about 2.75 to about 3 times said initial flow rate.

6. A resid conversion process in accordance with claim 5 wherein said flow rate of said lean sponge oil is increased to about 22,000 bpd to about 30,000 bpd and said flow rate of said feed gas is decreased to about 2.4 MMSCFH to about 2.75 MMSCFH.

7. A resid conversion process in accordance with claim 1 including increasing said concentration and purity of said hydrogen in said feed gas by about 5% to about 20% by volume.

8. A resid conversion process in accordance with claim 7 wherein said hydrogen in said feed gas is about 84% to about 86% by volume.

9. A resid conversion process in accordance with claim 7 including bleeding off some of said upgraded effluent gases for use as fuel gas and increasing the concentration of said makeup gases in said feed gases.

10. A resid conversion process in accordance with claim 7 including heating said feed gases to a temperature ranging from about 650° F. to about 900° F. before said feed gases are injected into said ebullated bed reactors.

11. A resid conversion process including:

increasing production of naphtha in said towers by about 4% to about 18% by weight;

increasing production of distillates from said atmospheric tower by about 13% to about 42% by weight; and decreasing production of vacuun: resid oil from said vacuum tower by about 9% to about 52% by weight.

12. A resid conversion process, comprising the steps of:

feeding relatively high sulfur resid oil to a reactor train comprising a series of three ebullated bed reactors;

conveying a catalyst to said reactor train;

injecting feed gases comprising about 84% to about 86% by volume hydrogen into said ebullated bed reactors at a feed gas rate of about 2.4 MMSCFH to about 2.75 MMSCFH;

converting said resid oil to lower boiling hydrocarbons by contacting said resid oil in said series of three ebullated bed reactors with said feed gas in the presence of said catalyst at a temperature ranging from about 700° F. to about 850° F., at a pressure ranging from about 2,550 psia to about 3,050 psia, at a hydrogen partial pressure ranging from about 1500 psia to about 2400 psia to produce an upgraded product stream of upgraded resid oil containing effluent reactor tail gases comprising hydrogen, hydrogen sulfide, ammonia, water, methane and other light hydrocarbon gases;

substantially separating said upgraded resid oil from said effluent gases in at least one separator;

feeding said separated upgraded resid oil to an atmospheric tower; thereafter separating said upgraded resid oil in said atmospheric tower into at least one stream of naphtha, at least one stream of distillate, a stream of atmospheric gas oil, and a stream of atmospheric resid oil;

feeding said atmospheric resid oil to a vacuum tower;

separating said atmospheric resid oil in said vacuum tower into an overhead stream of vacuum gases, a stream of vacuum naphtha, at least one stream of vacuum gas oil, and a bottom stream of vacuum resid oil;

cooling said effluent gases;

reacting said effluent gases with water to form soluble ammonium bisulfide;

conveying said cooled effluent gases and water to a sponge oil absorber;

feeding lean sponge oil at a feed rate of about 22 MB/D to about 30 MB/D into a sponge oil absorber;

separating a substantial amount of said light hydrocarbon gases from said effluent gases by extracting said light hydrocarbon gases from said effluent gases in said sponge oil absorber with said lean sponge oil and forming a discharge stream of rich sponge oil;

separating said ammonium bisulfide from said effluent gases by withdrawing said ammonium bisulfide from said sponge oil absorber;

withdrawing said rich sponge oil from said sponge oil absorber;

stripping said light hydrocarbon gases from said rich sponge oil to produce lean sponge oil and recycling said lean sponge oil to said sponge oil absorber;

conveying said remaining effluent gases from said sponge oil absorber to an amine absorber;

feeding lean amine to said amine absorber;

absorbing a substantial amount of said hydrogen sulfide from said effluent gases with said lean amine in said amine absorber to produce upgraded effluent gases comprising about 84% to about 86% by volume hydrogen;

compressing said upgraded effluent gases to substantially increase the pressure of said upgraded effluent gases;

recycling said compressed gases to said series of three ebullated bed reactors as part of said feed gas; and blending said compressed gases with makeup gases comprising at least about 95% by volume hydrogen to form upgraded gases comprising about 84% to about 86% by volume hydrogen for use as said feed gases while concurrently maintaining said lean sponge oil feed rate at about 22 MB/D to about 30 MB/D and concurrently producing upgraded effluent gases comprising about 84% to about 86% by volume hydrogen to convert at least about 40% to about 90% of said resid oil in said series of three ebullated bed reactors to said lower boiling liquid products.

13. A resid conversion process in accordance with claim 12 wherein the product slate produced in said towers comprises:

about 1.7% to about 6.8% by volume light hydrocarbon gases;

about 4.1% to about 18.4% by weight naphtha;

about 13.7% to about 42% by weight distillates;

about 19% to about 34% by weight gas oil; and about 9% to about 52% upgraded resid.

* * * * *

UNITED STATES PATENT OFFICE

CERTIFICATE OF CORRECTION

Patent No. 4,743,356 Dated May 10, 1988

Inventor(s) DAVID J. SODERBERG - NORMAN K. MCDANIEL - NORMAN R. WOODS

It is certified that error appears in the above-identified patent and that said Letters Patent is hereby corrected as shown below:

| Col. | Line | |
|---|---|---|
| 1 | 67 | "problems. lems." should be -- problems. -- |
| 5 | 42 | "hydrogenrich" should be -- hydrogen-rich -- |
| 6 | 35 | "hydrowith treating catalyst" should be -- hydrotreating catalyst -- |
| 7 | 24 | "high temperature" should be -- high-temperature -- |
| 9 | 27 | "highpressure" should be -- high-pressure -- |
| 10 | 3 | "lowpressure" should be -- low-pressure -- |
| 11 | 57 | "scrubber (20 through" should be -- scrubber 370 through -- |
| 17 | 25 | "requirments" should be -- requirements -- |
| 17 | 25 | "compressor" should be -- recycle gas compressor -- |
| 17 | 31 | "inthe" should be -- in the -- |
| 17 | 34 | "is" should be -- is: -- |

UNITED STATES PATENT OFFICE

CERTIFICATE OF CORRECTION

Patent No. 4,743,356 Dated May 10, 1988

Inventor(s) DAVID J. SODERBERG - NORMAN K. MCDANIEL - NORMAN R. WOODS

It is certified that error appears in the above-identified patent and that said Letters Patent is hereby corrected as shown below:

| Col. | Line | |
|---|---|---|
| 18 | 65 | "in high-temperature" should be -- in a high-temperature -- |
| 19 | 36 | "vacuun:" should be -- vacuum -- |

Signed and Sealed this

Eighth Day of January, 1991

*Attest:*

HARRY F. MANBECK, JR.

*Attesting Officer*

*Commissioner of Patents and Trademarks*